US005520163A

United States Patent [19]

Hurd

[11] Patent Number: 5,520,163

[45] Date of Patent: May 28, 1996

[54] BOW-ATTACHED, ARROW LAUNCHING APPARATUS

[76] Inventor: David L. Hurd, Rte. 3 Box 789-A, Tazewell, Va. 24651

[21] Appl. No.: 351,950

[22] Filed: Dec. 8, 1994

[51] Int. Cl.[6] ..... F41B 5/00

[52] U.S. Cl. ..... 124/24.1; 124/86

[58] Field of Search ..... 124/23.1, 24.1, 124/25.6, 44.5, 86, 88

[56] References Cited

U.S. PATENT DOCUMENTS

| | | | |
|---|---|---|---|
| 2,926,650 | 3/1960 | Irwin | 124/24.1 |
| 4,027,645 | 6/1977 | Damron | 124/24.1 |
| 4,708,341 | 11/1987 | Paraskevakos | 124/24.1 X |
| 4,829,974 | 5/1989 | Anderson | 124/24.1 |
| 4,924,841 | 5/1990 | Smith | 124/44.5 |
| 4,949,699 | 8/1990 | Gerber | 124/44.5 |
| 5,081,980 | 1/1992 | Newbold | 124/44.5 |
| 5,119,797 | 6/1992 | Anderson | 124/25 |
| 5,181,502 | 1/1993 | Ray | 124/44.5 |
| 5,263,465 | 11/1993 | Anderson | 124/24.1 |

*Primary Examiner*—Eric K. Nicholson
*Assistant Examiner*—John A. Ricci

[57] ABSTRACT

A bow-attached, arrow launching apparatus, for launching a shorter-than-conventional-length arrow, includes a bow attachment assembly adapted to be attached perpendicularly to a bow and includes an extensible and retractable arrow guide assembly. The front end of the arrow guide assembly is connected to the bow attachment assembly such that the arrow guide assembly is oriented perpendicularly with respect to the bow attachment assembly. The rear end of the arrow guide assembly is adapted to contact a bow string. The arrow guide assembly is adapted to receive an arrow for launching from the arrow guide assembly. The arrow guide assembly includes a pair of extensible and retractable guide track assemblies. A plurality of spacer supports are connected to the guide track assemblies and support the guide track assemblies at least a predetermined distance from one another. A first spacer support is connected to the bow attachment assembly, and a bow string guide assembly is connected between the guide track assemblies at the rear end of the arrow guide assembly. The at least predetermined distance spaced between the guide track assemblies is less than the head width of the head portion of the arrow and is less than the tail width of the tail portion of the arrow. Each of the guide track assemblies includes a plurality of telescopic segments adapted to be arranged in either a retracted orientation or an extended orientation.

6 Claims, 4 Drawing Sheets

FIG 5
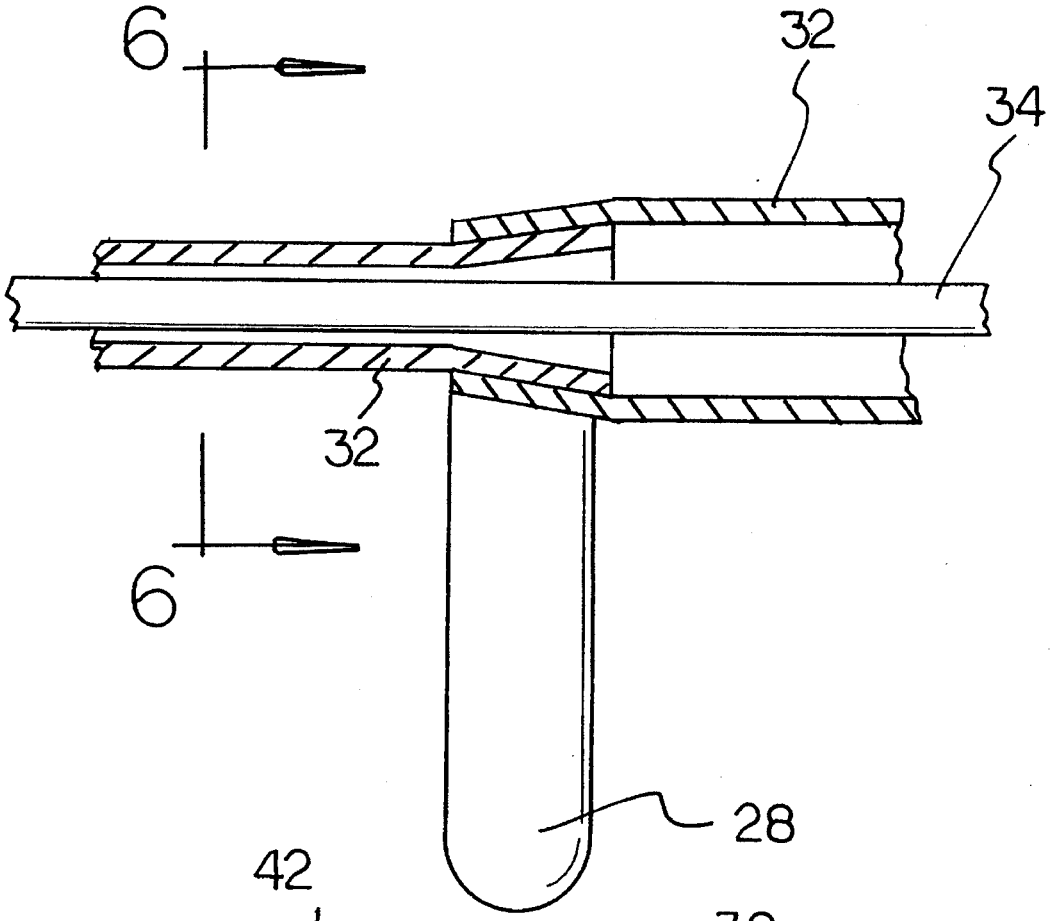
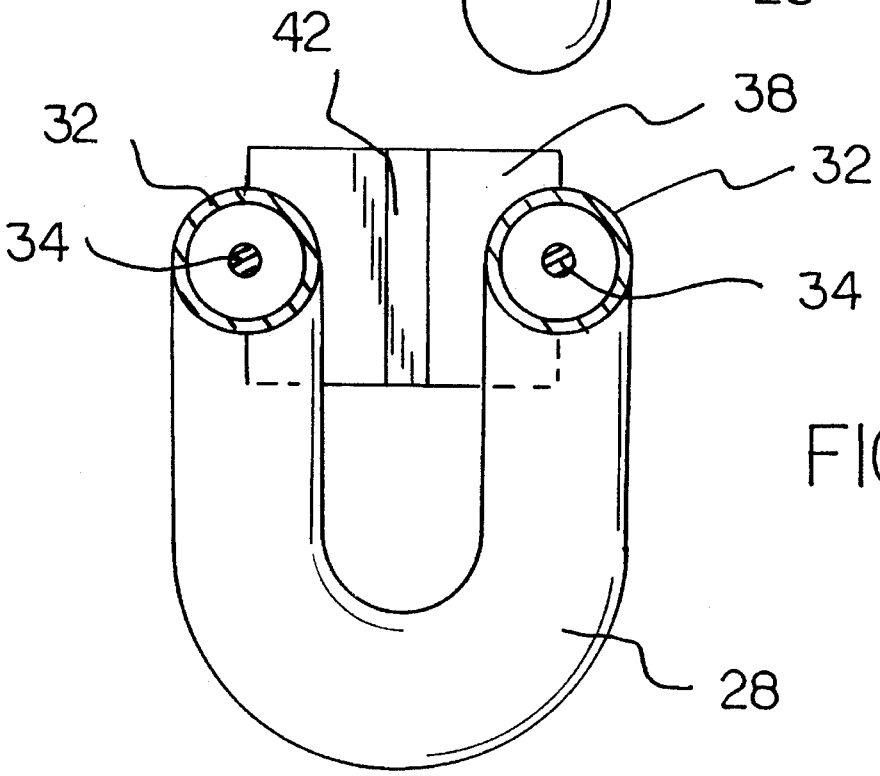
FIG 6

BOW-ATTACHED, ARROW LAUNCHING APPARATUS

BACKGROUND OF THE INVENTION

1. Field of the Invention

The present invention relates generally to bows and arrows and, more particularly, to an attachment to a bow especially adapted for launching arrows.

2. Description of the Prior Art

In the sport of archery, conventional bows are often used with conventional arrows. With conventional arrows, the rear end of a conventional arrow is placed against the bow string, and the bow string is pulled back. The front end of the arrow slides against the bow until the arrow head is near the bow. Then the bow string is released, and the arrow is shot. To span the distance from the rear end of the arrow to the arrow head, conventional arrows must be a certain conventional length. Such conventional length arrows are relatively heavy and have an inherent limitation as to the distance they can travel without dropping in elevation. Often such conventional length arrows are approximately thirty-one inches long. A plurality of conventional length arrows weighs a certain weight that is relatively heavy and occupies a certain space that is relatively large. Therefore, in view of the above, it would be desirable to provide a bow and arrow combination that employed arrows that are shorter than conventional length. By using arrows that are shorter than conventional length, a person can readily carry more arrows along when engaging in archery. Moreover, arrows that are shorter that conventional length permit a greater travel distance without a drop in elevation.

It is conceivable that a person could attempt to employ an arrow that is shorter than conventional length with a conventional bow. If such were done, the bow string could not be pulled back far enough to provide an effective stretch of the bow and bow string to propel the shorter-than-conventional-length arrow effectively. Therefore, it would be desirable to provide a bow and bow string that can be sufficiently stretched to effectively propel a shorter-than-conventional-length arrow.

There are currently many conventional bows which employ conventional length arrows in use. It would be desirable, therefore, to be able to readily convert a conventional bow into a novel bow that can be employed to launch shorter-than-conventional-length arrows.

A rear end of a conventional arrow generally includes a slot into which the bow string fits. Sometimes, however, there is a binding between the slot and the bow string, and the arrow does not cleanly release from the bow string. As a result, the arrow does not fly as far and as straight as desired. In this respect, it would be desirable if arrows can be provided which permit an arrow to be propelled by a bow string without employing a slot at the rear end of the arrow.

Generally, with a conventional arrow and a conventional bow, the rear end of the arrow is pinched between the index finger and the thumb, and the pinched arrow is pulled back in order to stretch the bow string. Such a pinching and pulling operation may be very tiring. Moreover, with such a pinching and pulling operation, it may be quite difficult for a person to muster sufficient pinching and pulling strength to pull the bow string back a suitable distance to provide a suitable tension in the bow string. In this respect, it would be desirable if the rear end of an arrow and the bow string could be pulled back without using a pinching and pulling action on the rear end of the arrow.

Throughout the years, a number of innovations have been developed relating to the sport of archery, and the following U.S. patents are representative of some of those innovations: U.S. Pat. Nos. 4,924,841; 4,949,699; 5,081,980; 5,119,797; and 5,181,502. More specifically, U.S. Pat. Nos. 4,924,841, 4,949,699, 5,081,980, and 5,181,502 disclose arrow guides mounted on bows. Conventional length arrows are used with such arrow guides.

U.S. Pat. No. 5,119,797 discloses a crossbow kit device that enables the use of shorter-than-conventional-length arrows. More specifically, a rigid, constant length track is provided for launching the shorter-than-conventional-length arrows. The rigid, constant length track takes up a considerable amount of linear space. Such space is inconvenient for storage purposes. In this respect, it would be desirable if a track for launching a shorter-than-conventional-length arrow had a relatively short length for storage purposes. Moreover, with this device a crossbow is employed. That is, the bow must be maintained in a horizontal orientation in order to operate satisfactorily. Crossbows are often deemed to be unwieldy because they must be maintained in their horizontal orientation. In this respect, it would be desirable a launching device for a shorter-than-conventional-length arrow were provided that could be employed with a vertically oriented bow.

Thus, while the foregoing body of prior art indicates it to be well known to use guides for conventional arrows, the prior art described above does not teach or suggest a bow-attached, arrow launching apparatus which has the following combination of desirable features: (1) employs arrows that are shorter than conventional length; (2) provides a bow and bow string that can be sufficiently stretched to effectively propel a shorter-than-conventional-length arrow; (3) is able to readily convert a conventional bow into a novel bow that can be employed to launch shorter-than-conventional-length arrows; (4) provides arrows which permit the arrows to propelled by a bow string without employing a slot at the rear ends of the arrows; (5) permits pulling back the rear end of an arrow and the bow string without using a pinching and pulling action on the rear end of the arrow; (6) provides a track for launching a shorter-than-conventional-length arrow wherein the track has a relatively short length for storage purposes; and (7) provides a launching device for a shorter-than-conventional-length arrow that can be employed with a vertically oriented bow. The foregoing desired characteristics are provided by the unique bow-attached, arrow launching apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, is a bow-attached, arrow launching apparatus provided for launching an arrow that has a head portion having a head width and that has a tail portion having a tail width. The bow-attached, arrow launching apparatus includes a bow attachment assembly adapted to be attached perpendicularly to a bow and includes an extensible and retractable arrow guide assembly which includes a front end and a rear end. The front end of the arrow guide assembly is connected to the bow attachment assembly such that the arrow guide assembly is oriented perpendicularly with respect to the bow attachment assembly. The rear end of the arrow guide assembly is adapted to contact a bow string. The arrow guide assembly is adapted to receive an arrow for launching from the arrow guide assembly.

The arrow guide assembly includes a pair of extensible and retractable guide track assemblies. A plurality of spacer supports are connected to the guide track assemblies and support the guide track assemblies at least a predetermined distance from one another. A first spacer support is connected to the bow attachment assembly, and a bow string guide assembly is connected between the guide track assemblies at the rear end of the arrow guide assembly. The at least predetermined distance spaced between the guide track assemblies is less than the head width of the head portion of the arrow and is less than the tail width of the tail portion of the arrow.

Each of the guide track assemblies includes a plurality of telescopic segments adapted to be arranged in either a retracted orientation or an extended orientation. An elastic resilient member is connected between a front telescopic segment and a rear telescopic segment for urging the telescopic segments to a retracted orientation with respect to each other.

Each of the guide track assemblies further includes a damper spring assembly connected at a rear portion of the rear telescopic segment for cushioning an impact of the rear telescopic segment against the front telescopic segment when the telescopic segments move from an extended orientation to a retracted orientation.

The bow string guide assembly includes a bridge block connected between the guide track assemblies. The bridge block includes a groove adapted for receiving the bow string. The groove permits the bow string to move against the bridge block without is grabbed by the bridge block. The bow string guide assembly further includes a cover member adapted to cover the groove when a bow string is retained in the groove. The bow string guide assembly further includes a magnet connected to the bridge block.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bow-attached, arrow launching apparatus which has all of the advantages of the prior art and none of the disadvantages.

It is another object of the present invention to provide a new and improved bow-attached, arrow launching apparatus which may be easily and efficiently manufactured and marketed.

It is a further object of the present invention to provide a new and improved bow-attached, arrow launching apparatus which is of durable and reliable construction.

An even further object of the present invention is to provide a new and improved bow-attached, arrow launching apparatus which is susceptible of a low cost of manufacture with regard to both materials and labor, and which accordingly is then susceptible of low prices of sale to the consuming public, thereby making such bow-attached, arrow launching apparatus available to the buying public.

Still yet a further object of the present invention is to provide a new and improved bow-attached, arrow launching apparatus which employs arrows that are shorter than conventional length.

Still another object of the present invention is to provide a new and improved bow-attached, arrow launching apparatus that provides a bow and bow string that can be sufficiently stretched to effectively propel a shorter-than-conventional-length arrow.

Yet another object of the present invention is to provide a new and improved bow-attached, arrow launching apparatus which is able to readily convert a conventional bow into a novel bow that can be employed to launch shorter-than-conventional-length arrows.

Even another object of the present invention is to provide a new and improved bow-attached, arrow launching apparatus that provides arrows which permit the arrows to propelled by a bow string without employing a slot at the rear ends of the arrows.

Still a further object of the present invention is to provide a new and improved bow-attached, arrow launching apparatus which permits pulling back the rear end of an arrow and the bow string without using a pinching and pulling action on the rear end of the arrow.

Yet another object of the present invention is to provide a new and improved bow-attached, arrow launching apparatus that provides a track for launching a shorter-than-conventional-length arrow wherein the track has a relatively short length for storage purposes.

Yet an even further object of the present invention is to provide a new and improved bow-attached, arrow launching apparatus which provides a launching device for a shorter-than-conventional-length arrow that can be employed with a vertically oriented bow.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is an enlarged view of the circled region 5 in FIG. 4.

FIG. 6 is a cross-sectional view of the portion of the embodiment of the invention shown in FIG. 5 taken along line 6—6 of FIG. 5.

DESCRIPTION OF THE PREFERRED EMBODIMENT

Figure 1:
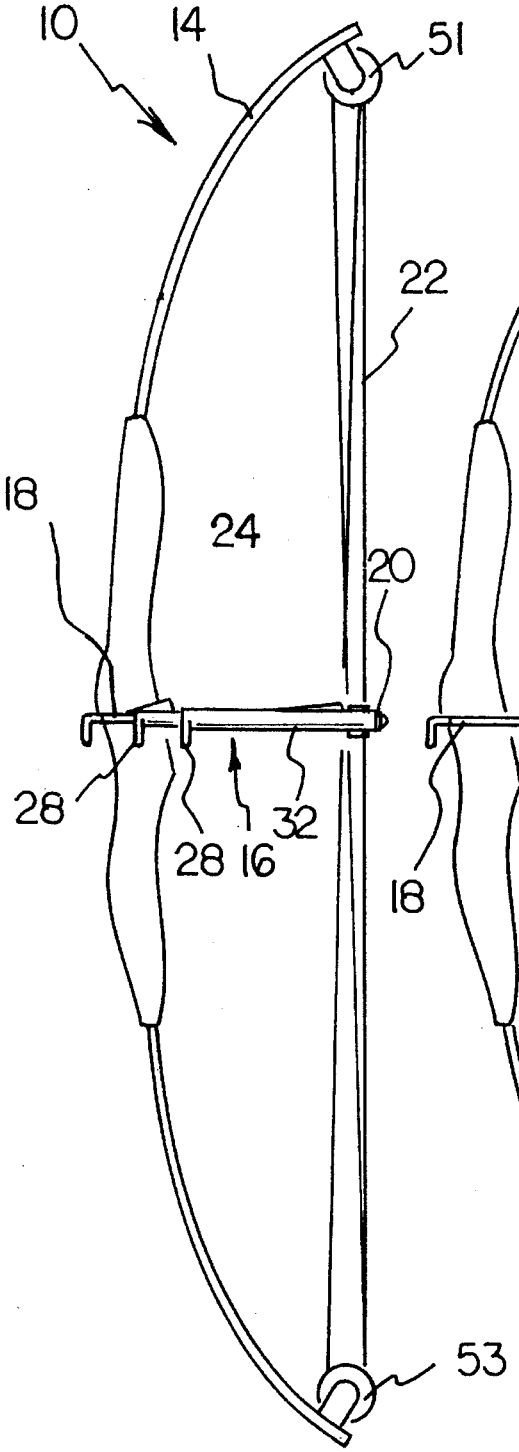
FIG. 1 is a side view showing a preferred embodiment of the bow-attached, arrow launching apparatus of the invention, in a retracted orientation, attached to a vertically oriented bow.

With reference to the drawings, a new and improved bow-attached, arrow launching apparatus embodying the principles and concepts of the present invention will be described.

Turning to FIGS. 1–8, there is shown an exemplary embodiment of the bow-attached, arrow launching apparatus of the invention generally designated by reference numeral 10. In its preferred form, bow-attached, arrow launching apparatus 10 is provided for launching an arrow 24 that has a head portion 50 having a head width 52 and that has a tail portion 54 having a tail width 56. The bow-attached, arrow launching apparatus 10 includes a bow attachment assembly 12 adapted to be attached perpendicularly to a bow 14 and includes an extensible and retractable arrow guide assembly 16 which includes a front end 18 and a rear end 20. The front end 18 of the arrow guide assembly 16 is connected to the bow attachment assembly 12 such that the arrow guide assembly 16 is oriented perpendicularly with respect to the bow attachment assembly 12. The rear end 20 of the arrow guide assembly 16 is adapted to contact a bow string 22. The arrow guide assembly 16 is adapted to receive an arrow 24 for launching from the arrow guide assembly 16. The arrow 24 can be a shorter-than-conventional-length arrow such as a 10 inch arrow. Alternatively, a conventional-length arrow, such as a 31 inch arrow, can also be used.

The arrow guide assembly 16 includes a pair of extensible and retractable guide track assemblies 26. A plurality of spacer supports 28 are connected to the guide track assemblies 26 and support the guide track assemblies 26 at least a predetermined distance 27 from one another. A first spacer support 28 is connected to the bow attachment assembly 12, and a bow string guide assembly 30 is connected between the guide track assemblies 26 at the rear end 20 of the arrow guide assembly 16. The at least predetermined distance 27 spaced between the guide track assemblies 26 is less than the head width 52 of the head portion 50 of the arrow 24 and is less than the tail width 56 of the tail portion 54 of the arrow 24.

Each of the guide track assemblies 26 includes a plurality of telescopic segments 32 adapted to be arranged in either a retracted orientation or an extended orientation. An elastic resilient member 34 is connected between a front telescopic segment 32 and a rear telescopic segment 32 for urging the telescopic segments 32 to a retracted orientation with respect to each other. It is noted that the predetermined distance 27 between the front telescopic segments 32 is greater than a predetermined distance 29 between the rear telescopic segments 32 because of the nature of telescopic segments 32. The rear telescopic segments 32 have a greater outer diameter that the front telescopic segments 32. However, both the predetermined distance 27 and the predetermined distance 29 are less than the head width 52 and the tail width 56 of the arrow 24.

Each of the guide track assemblies 26 further includes a damper spring assembly 36 connected at a rear portion of the rear telescopic segment 32 for cushioning an impact of the rear telescopic segment 32 against the front telescopic segment 32 when the telescopic segments 32 move from an extended orientation to a retracted orientation. The damper spring assembly 36 can be provided as an insert that is inserted into the rear end of the rear telescopic segment 32.

The bow string guide assembly 30 includes a bridge block 38 connected between the guide track assemblies 26. The bridge block 38 includes a groove 40 adapted for receiving the bow string 22. The groove 40 permits the bow string 22 to move against the bridge block 38 without is grabbed by the bridge block 38. The bow string guide assembly 30 further includes a cover member 46 adapted to cover the groove 40 when a bow string 22 is retained in the groove 40. Screws 47 are used to secure the cover member 46 to the bridge block 38. The bow string guide assembly 30 further includes a magnet 42 connected to the bridge block 38. The magnet 42 is adapted to attract the rear end of an arrow 24 which is equipped with its own magnet 44 located at the rear end of the arrow 24. The magnet 44 can be provided as a magnetic cap placed at the end the of the arrow 24.

In operation of the bow-attached, arrow launching apparatus 10, as shown in FIG. 1, the apparatus is first installed on a bow 14. To do this, a hole is drilled in the bow 14, and a portion of the bow attachment assembly 12 is passed through the hole. More specifically, the bow attachment assembly 12 is in the form of a threaded bolt. A first nut 60 and first washer 61 are first placed on the threaded bolt. Then, the threaded bolt is passed through the hole in the bow 14. Then, a second washer 62 and second nut 63 are placed on the threaded bolt. When the first nut 60 and second nut 63 are turned towards each other, the first washer 61 and the second washer 62 sandwich the bow 14 therebetween and secure the bow-attached, arrow launching apparatus 10 to the bow 14. The hole is drilled in the bow 14 so that the bow-attached, arrow launching apparatus 10 embodiment of the invention is oriented perpendicular to the bow 14.

As shown in FIG. 1, the bow-attached, arrow launching apparatus 10 is in a retracted position. An arrow 24 is placed on the pair of guide track assemblies 26 near the rear of the arrow guide assembly 16. The head portion 50 and the tail portion 54 of the arrow 24 are wider than the predetermined distance 27 between the guide track assemblies 26. As a result, the arrow 24 is retained by the guide track assemblies 26.

Figure 2:
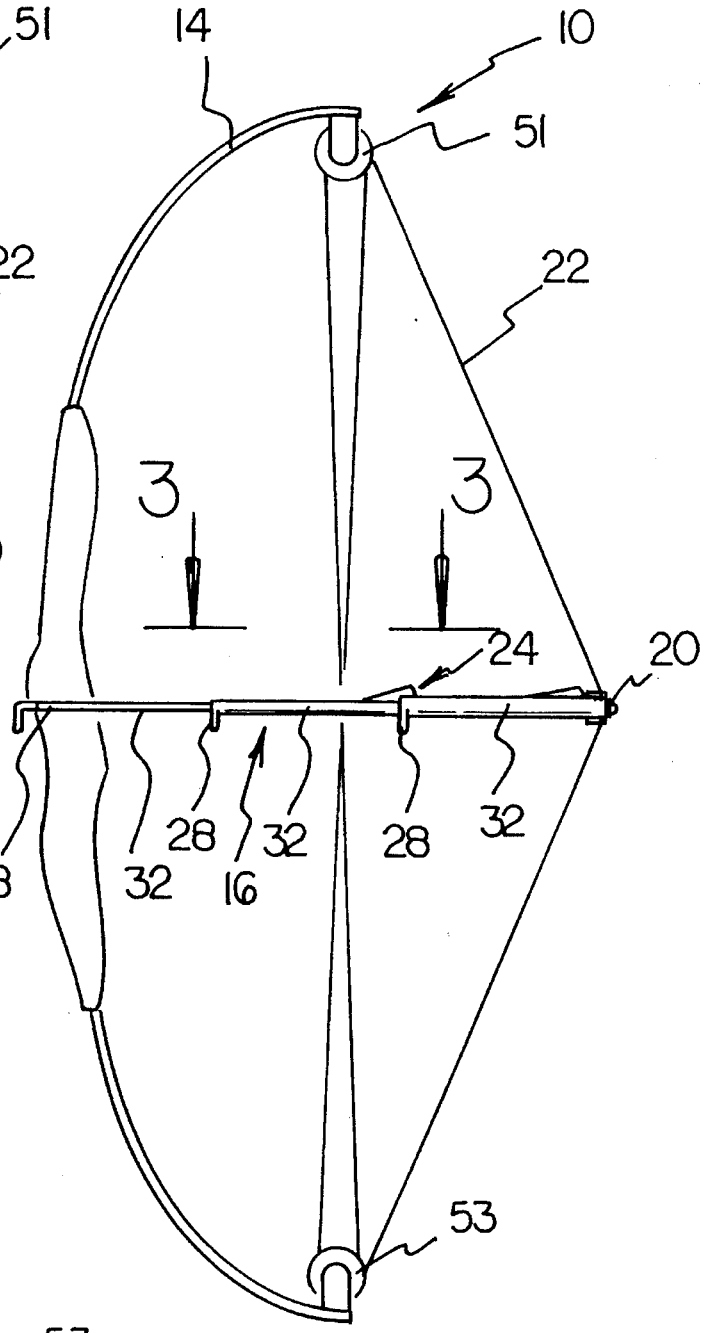
FIG. 2 is a side view of the embodiment of the bow-attached, arrow launching apparatus shown in FIG. 1 wherein the apparatus is in an extended orientation prior to launching a shorter-than-conventional-length arrow.
Figure 3:
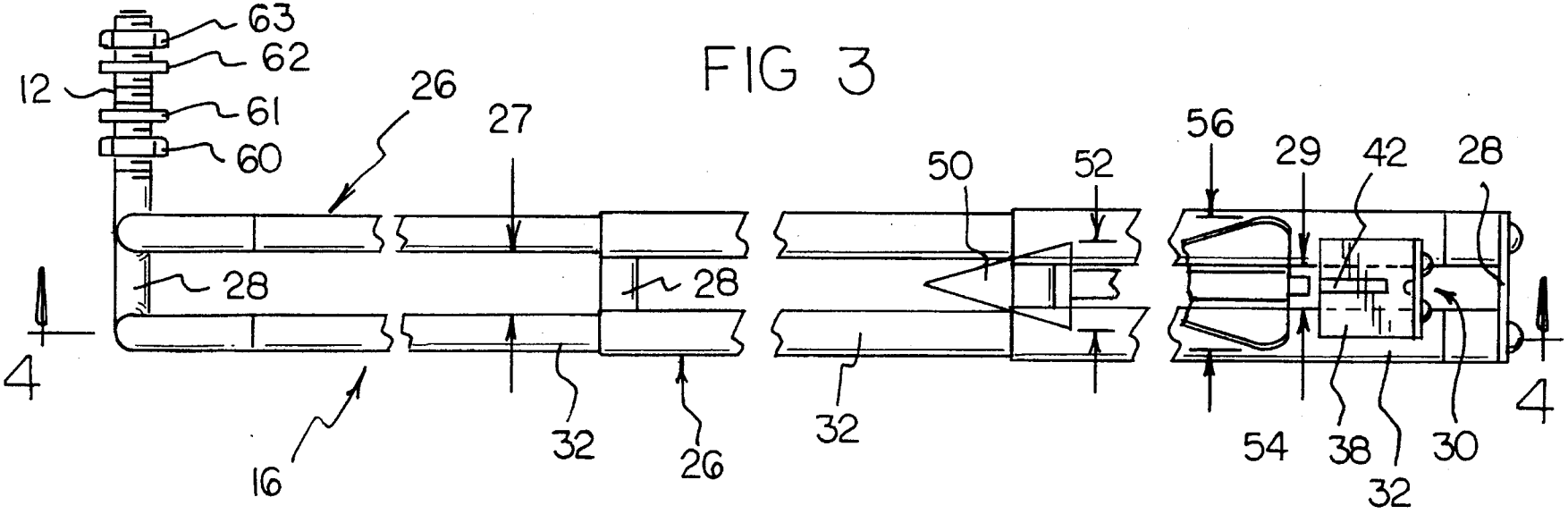
FIG. 3 is an enlarged top view of the embodiment of the bow-attached, arrow launching apparatus of FIG. 2 taken along line 3—3 thereof.
Figure 4:
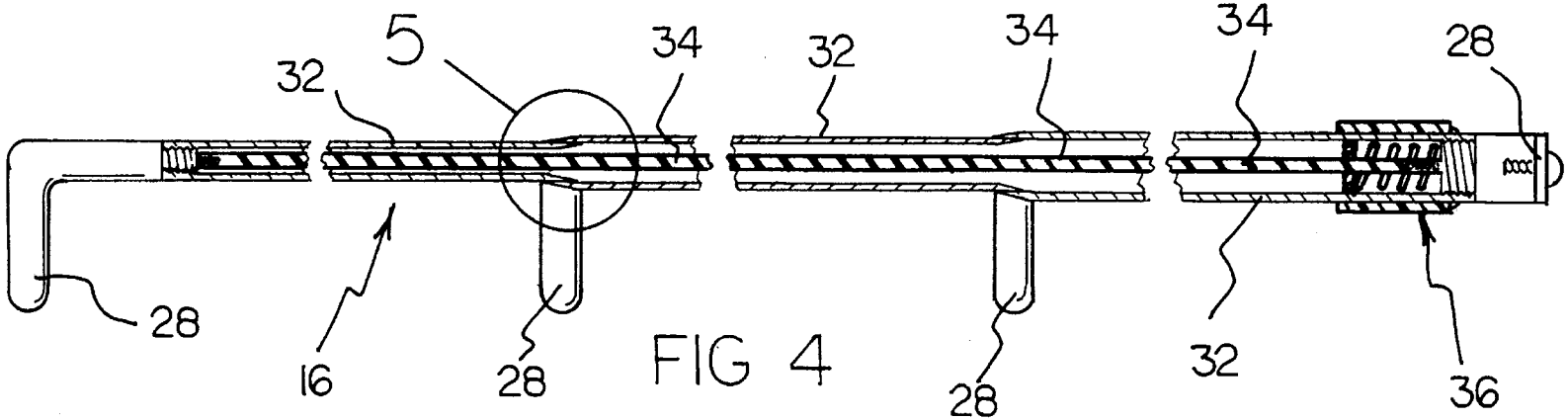
FIG. 4 is a cross-sectional view of the embodiment of the invention shown in FIG. 3 taken along line 4—4 thereof.
Figure 7:
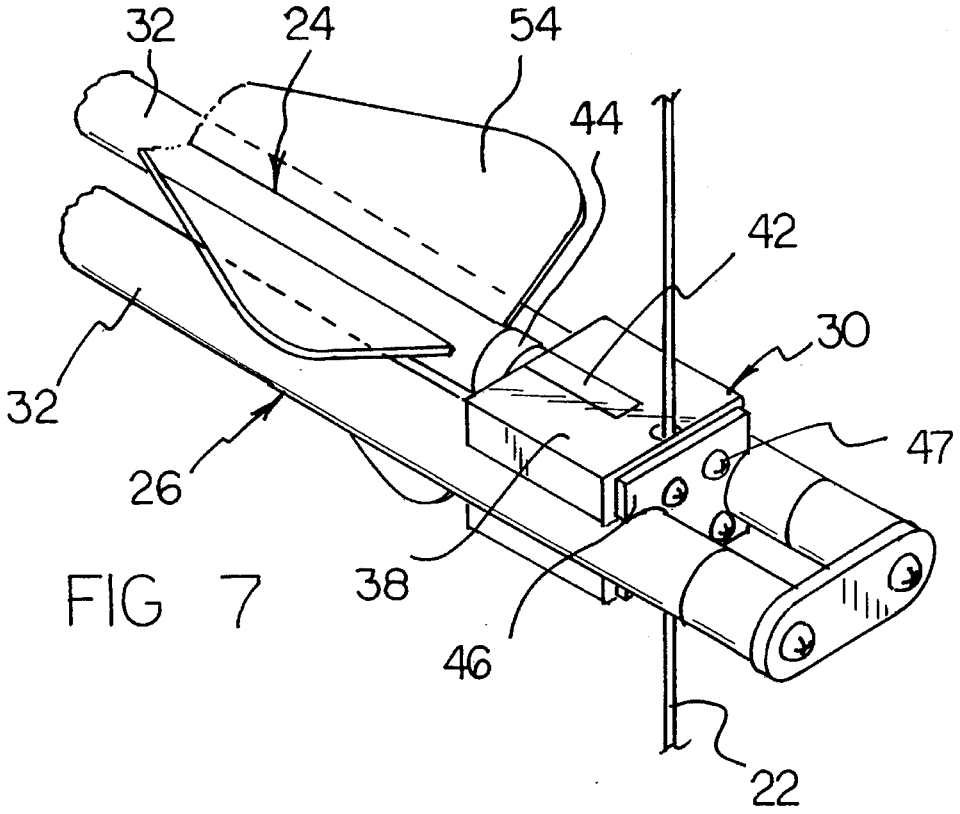
FIG. 7 is an enlarged, partial perspective view of a rear portion of the embodiment of the invention shown in FIG. 3.
Figure 8:
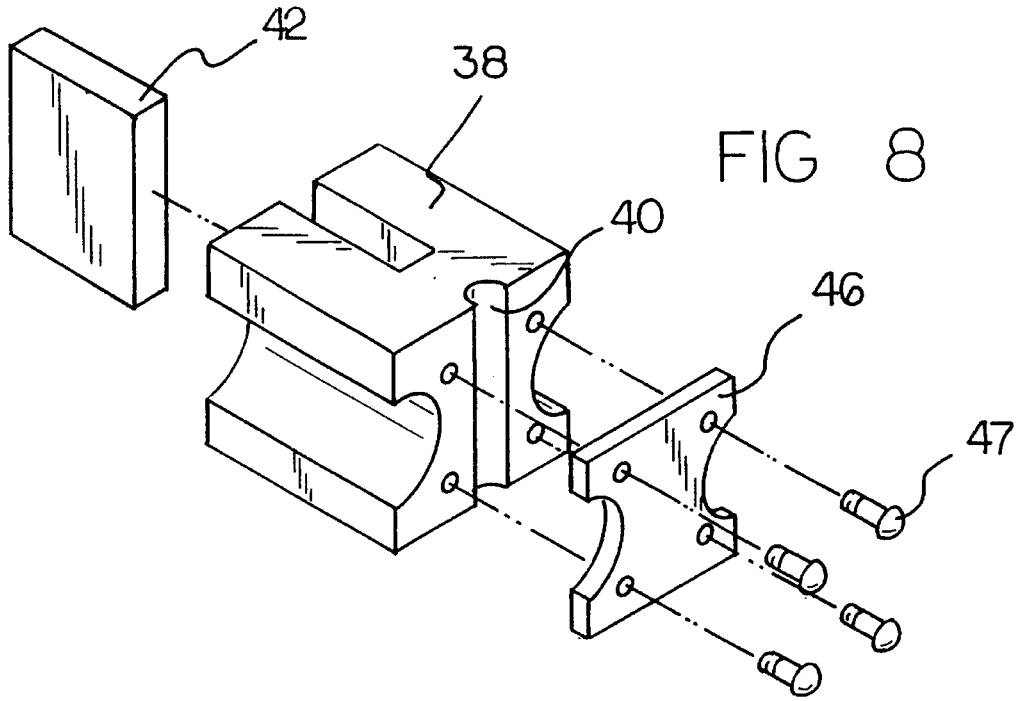
FIG. 8 is an exploded perspective view of a portion of the rear portion of the embodiment of the invention shown in FIG. 7.

As shown in FIG. 2, the rear spacer support 28 has been pulled back by a user so that the bridge block 38 pulls back on the bow string 22 which is threaded in the groove 40 of the bridge block 38 below the cover member 46. As the bow string 22 moves backward, the bow 14 is flexed to the flexed condition shown in FIG. 2.

The bridge block 38 includes a magnet 42. In addition, the rear end of the arrow 24 includes a magnet 44. Therefore, as the bridge block 38 and the bow string 22 move backward, the magnet 42 in the bridge block 38 pulls on the magnet 44 of the arrow 24, thereby pulling the arrow 24 back also. As shown in FIGS. 1 and 2, the bow string 22 is threaded around an upper pulley 51 and a lower pulley 53. The threading of the bow string 22 around the upper pulley 51 and the lower pulley 53 provides extra mechanical advantage for flexing the bow 14 into the flexed condition shown in FIG. 2.

Also, as the bow string 22 moves backward and the bow 14 flexes, the plurality of telescopic segments 32 move from the retracted orientation shown in FIG. 1 to the extended orientation shown in FIG. 2. Inside the telescopic segments 32, the elastic resilient member 34 is stretched. In the orientation shown in FIG. 2, the arrow 24 is ready to be launched from the arrow guide assembly 16. This is done merely by releasing the rear end 20 of the arrow guide assembly 16.

When the rear end 20 of the arrow guide assembly 16 is released, the flexed bow 14 and the stretched elastic resilient member 34 rapidly return to their original, unstressed condition, thereby causing the arrow 24 to be launched from the arrow guide assembly 16. The relatively weak attraction between the magnet 42 on the bridge block 38 and the magnet 44 on the arrow 24 is easily broken when the arrow 24 is propelled forward when the rear end 20 of the arrow guide assembly 16 is released to launch the arrow 24. Thereby, the arrow 24 flies away from the bow-attached, arrow launching apparatus 10.

When the plurality of the telescopic segments 32 rapidly move from the extended orientation to the retracted orientation shown in FIG. 1, there is a tendency of the rear end 20 of the arrow guide assembly 16 to rapidly advance to the front end 18 of the arrow guide assembly 16. As a result, the rear end 20 bumps into the front end 18. To reduce a jolting shock, the damper spring assembly 36 is provided to cushion the impact between the rear telescopic segment 32 and the front telescopic segment 32 of the arrow guide assembly 16.

The two guide track assemblies 26 of the arrow guide assembly 16 are placed in a coplanar arrangement with respect to a plane that is perpendicular to the plane in which the bow 14 and bow string 22 reside.

The telescopic segments 32 can be made from chrome/molly tube material. Other components of the bow-attached, arrow launching apparatus of the invention can be made from inexpensive and durable metal, plastic, and rubber materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved bow-attached, arrow launching apparatus that is low in cost, relatively simple in design and operation, and which may advantageously be used to employ arrows that are shorter than conventional length. With the invention, a bow-attached, arrow launching apparatus provides a bow and bow string that can be sufficiently stretched to effectively propel a shorter-than-conventional-length arrow. With the invention, a bow-attached, arrow launching apparatus is provided which is able to readily convert a conventional bow into a novel bow that can be employed to launch shorter-than-conventional-length arrows. With the invention, a bow-attached, arrow launching apparatus provides arrows which permit the arrows to propelled by a bow string without employing a slot at the rear ends of the arrows. With the invention, a bow-attached, arrow launching apparatus is provided which permits pulling back the rear end of an arrow and the bow string without using a pinching and pulling action on the rear end of the arrow. With the invention, a bow-attached, arrow launching apparatus provides a track for launching a shorter-than-conventional-length arrow wherein the track has a relatively short length for storage purposes. With the invention, a bow-attached, arrow launching apparatus provides a launching device for a shorter-than-conventional-length arrow that can be employed with a vertically oriented bow.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A bow-attached, arrow launching apparatus for launching an arrow that has a head portion having a head width and that has a tail portion having a tail width, comprising:

a bow attachment assembly adapted to be attached perpendicularly to a bow, and an extensible and retractable arrow guide assembly which includes a front end and a rear end, wherein said front end is connected to said bow attachment assembly such that said arrow guide assembly is oriented perpendicularly with respect to said bow attachment assembly, wherein said rear end is adapted to contact a bow string, wherein said arrow guide assembly is adapted to receive an arrow for launching from said arrow guide assembly, wherein said arrow guide assembly includes:

a pair of extensible and retractable guide track assemblies, a plurality of spacer supports connected to said guide track assemblies and supported said guide track assemblies at least a predetermined distance from one another, wherein a first spacer support is connected to said bow attachment assembly, a bow string guide assembly connected between said guide track assemblies at said rear end of said arrow guide assembly, and wherein said at least predetermined distance spaced between said guide track assemblies is less than the head width of the head portion of the arrow and is less than the tail width of the tail portion of the arrow.

2. The apparatus of claim 1 wherein each of said guide track assemblies includes:

a plurality of telescopic segments adapted to be arranged in either a retracted orientation or an extended orientation, and an elastic resilient member connected between a front telescopic segment and a rear telescopic segment for urging said telescopic segments to a retracted orientation with respect to each other.

3. The apparatus of claim 2 wherein each of said guide track assemblies further includes:

a damper spring assembly, connected at a rear portion of said rear telescopic segment, for cushioning an impact of said rear telescopic segment against said front telescopic segment when said telescopic segments move from an extended orientation to a retracted orientation.

4. The apparatus of claim 1 wherein said bow string guide assembly includes a bridge block connected between said guide track assemblies, wherein said bridge block includes a groove adapted for receiving the bow string, wherein said groove permits the bow string to move against said bridge block without being grabbed by said bridge block.

5. The apparatus of claim 4 wherein said bow string guide assembly further includes a cover member adapted to cover said groove when a bow string is retained in said groove.

6. The apparatus of claim 4 wherein said bow string guide assembly further includes a magnet connected to said bridge block.

* * * * *